United States Patent [19]

Horgan, Jr.

[11] 4,006,768

[45] Feb. 8, 1977

[54] SECURITY SCREEN

[75] Inventor: William J. Horgan, Jr., Pittsburgh, Pa.

[73] Assignee: Blumcraft of Pittsburgh, Pittsburgh, Pa.

[22] Filed: Nov. 22, 1974

[21] Appl. No.: 526,101

[52] U.S. Cl. ..... 160/136; 160/159; 160/206

[51] Int. Cl.[2] ..... E06B 3/92

[58] Field of Search ..... 160/117, 118, 119, 84 V, 160/136, 159, 160, 163

[56] References Cited

UNITED STATES PATENTS

| | | | |
|---|---|---|---|
| 191,984 | 6/1877 | Maddox | 160/118 |
| 582,098 | 5/1897 | Ruemmler et al. | 160/136 |
| 684,130 | 10/1901 | Taubert | 160/84 V |
| 1,550,713 | 8/1925 | Springer | 160/84 V |
| 1,644,285 | 10/1927 | Smith | 160/159 |
| 1,721,998 | 7/1929 | Jackson, Jr. | 160/159 |
| 1,878,034 | 9/1932 | Vansant | 160/159 |
| 2,520,664 | 8/1950 | Turner | 160/136 |
| 3,506,056 | 4/1970 | Quinones et al. | 160/160 |

*Primary Examiner*—Paul R. Gilliam
*Assistant Examiner*—Victor N. Sakran
*Attorney, Agent, or Firm*—Paul & Paul

[57] ABSTRACT

A security screen is provided, adapted to be applied inside windows, doors or the like, to be kept hidden from view when not in use, and which is of the type that has vertical bars that are connected by angular links, and with the screens generally being provided in pairs, for latching and locking at about the center of a window or door with respect to which security is desired. Particularly unique adjustability and versatility features are embodied in the screen, and security fasteners are used to fasten components together.

18 Claims, 16 Drawing Figures

SECURITY SCREEN

BACKGROUND OF THE INVENTION

Security screens are known in the art, but generally these screens are constructed so as to be substantially heavy, whereby opening or closing of the screens involves movement of a great amount of weight. This is often because the screens are constructed to be of the parallel linkage type, with the angularly moveable links that connect vertical bars in general traversing a plurality of such bars. Typical of the parallel linkage type of screen or gate is that disclosed in the patent to Coomes, U.S. Pat. No. 917,713.

Other foldable structures, principally of the gate type have been developed, that do not employ links that traverse a plurality of parallel vertical bars, but this type employs vertically moveable intermediate bars between the principal vertical bars, and in order to provide for such vertical movement, substantial unsecured areas exist above and below the area of principal screening when such screens or gates are in use. Typical of this type of gate is that shown in the patent to Jackson, U.S. Pat. No. 1,721,998.

The prior art directed to collapsible screeens or gates is apparently one that has developed at a time when customized design was possible for almost each installation.

THE PRESENT INVENTION

The present invention is directed toward providing a security screen system that will generally employ a pair of screens moveable toward each other for closing, and away from each other for opening, and which when fully open will be compact and will readily blend in with the decor of the room, building or like facility. For example, when fully opened and not in use, the screen components may be hidden behind an open drapery.

Principally, however, the screen system of the present invention is adapted to the provision of one screen system or kit that is sufficiently versatile and easily installed that it is adaptable for use with windows or doors of various sizes, in that a given size screen will accommodate a door or window width within a preselected range of sizes, and that same screen will accommodate windows or doors of heights that are also within a pre-selected range of sizes. The screen of the present invention is designed for particular ease of installation, most specifically so that it can accommodate imperfect alignments of the frame, including the guiding means in which it is mounted, and also for accommodating imperfect alignments of the window or door frames or the like.

This versatility allows the screen to be adjusted in situ, to give a uniform, balanced appearance, with equal spacing between adjacent vertical members or bars, if desired, and the installation may be done, if desired, by relatively unskilled personnel, due to the simplicity of assembly of the screen of the present invention.

Moreover, the screen of the present invention lends itself to distribution in kit form, due to its ease of assembly, and due to the versatile nature of a screen of one size, or preferably of a pair of screens (right and left screens together forming a pair) that is adaptable for a preselected range of window or door sizes. This enables the stocking of a limited range of pre-prepared kits, few in number, that among them can provide security for great numbers of different sized openings, and that can quickly be supplied upon demand, without requiring special fabricating to meet particular size requirements as is the case with many prior art types of security screens.

Moreover, the present invention employs a uniquely effective central lock, in those embodiments of the invention that utilize a pair of screens, with the lock employing a latching mechanism that is effective at several vertical spaced locations along the mating bars, and which may be securely locked.

The expandable screen of the present invention therefore provides security as an off-the-shelf item, at substantially reduced expense relative to a custom made screen. Also, by making the screen with a minimum number of parts, the cost is minimized and ease of assembly is maximized. One factor that facilitates the use of a minimum number of parts is the use of adjustably positionable stops. Accordingly, it is an object of the present invention to provide a screen that is infinitely expandable in both a horizontal and vertical direction, whereby a few (perhaps four) sizes are adapted to be adjusted to fit substantially all window and door sizes normally encountered.

It is a further object of the present invention to provide a security screen that is adapted for complete concealment behind draperies, yet which provides substantial security against forced entry.

It is another object of the present invention to provide a screen that eliminates the need for extreme care in squaring and aligning the assembly upon installation.

It is a further object of this invention to provide pre-prepared units fabricated from stock materials that can be simply cut to size, if desired, to fit the perimeter of a given window or door.

It is another object of the present invention to provide an expandable screen that lends itself to manufacture in such a way that, upon installation it provides a flexible web-like construction that allows for bending, but, though being somewhat flexibly moveable upon attempt being made to violate the security of the screen, and thereby resist sawing, cutting, etc., will nevertheless be sufficiently strong to accomplish its purposes, and, will work such that if screen components are bent, such will only cause the parts to lock more tightly together.

It is a further object of the present invention to provide a security screen of the expandable type that is adapted for latching and locking, and for ease of unlocking and unlatching, for egress in emergency situations.

It is a further object of the present invention to provide a screen that has a minimum number of criss-cross linking components, and of reduced weight for ease of operation.

It is another object of the present invention to provide a screen that lends itself to a variety of web patterns, if desired, merely by setting the components of the screen at selected distances relative to each other, as an in situ operation.

It is a further object of the present invention to provide a screen that is readily handleable and after installation is easily moveable freely in guides.

It is another object of this invention to provide novel security fasteners, separately, and for use with the security screen of the present invention.

Other objects and advantages of the present invention will become readily apparent to those skilled in the art by reading the following brief description of the drawing figures, detailed descriptions of the preferred embodiments, and the appended claims.

BRIEF DESCRIPTIONS OF THE DRAWINGS

Figure 2:
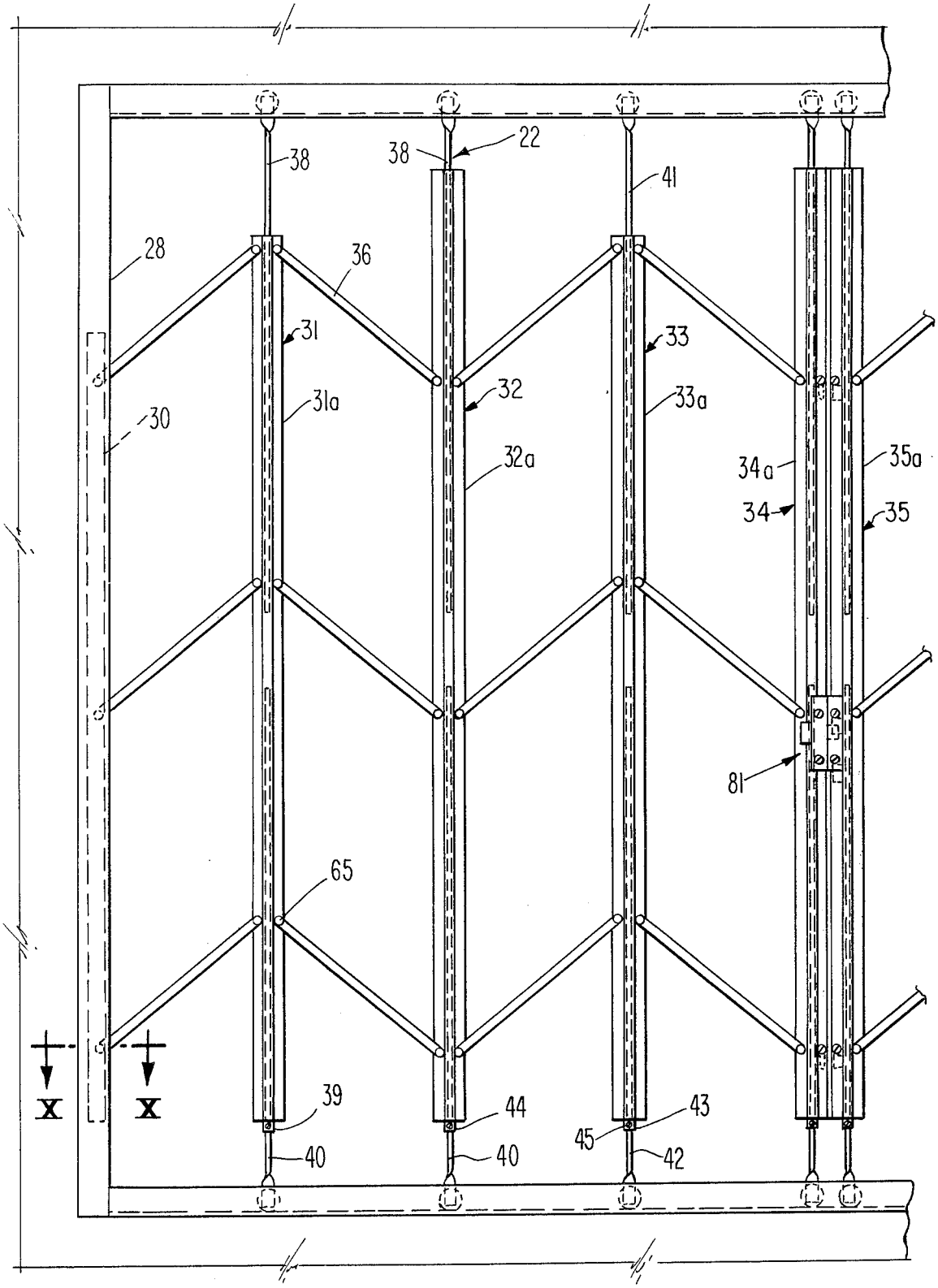
FIG. 2 is an enlarged frontal view of one of the screens of the pair of FIG. 1, with certain hidden components being illustrated in dotted lines, for ease of understanding.
Figure 5:
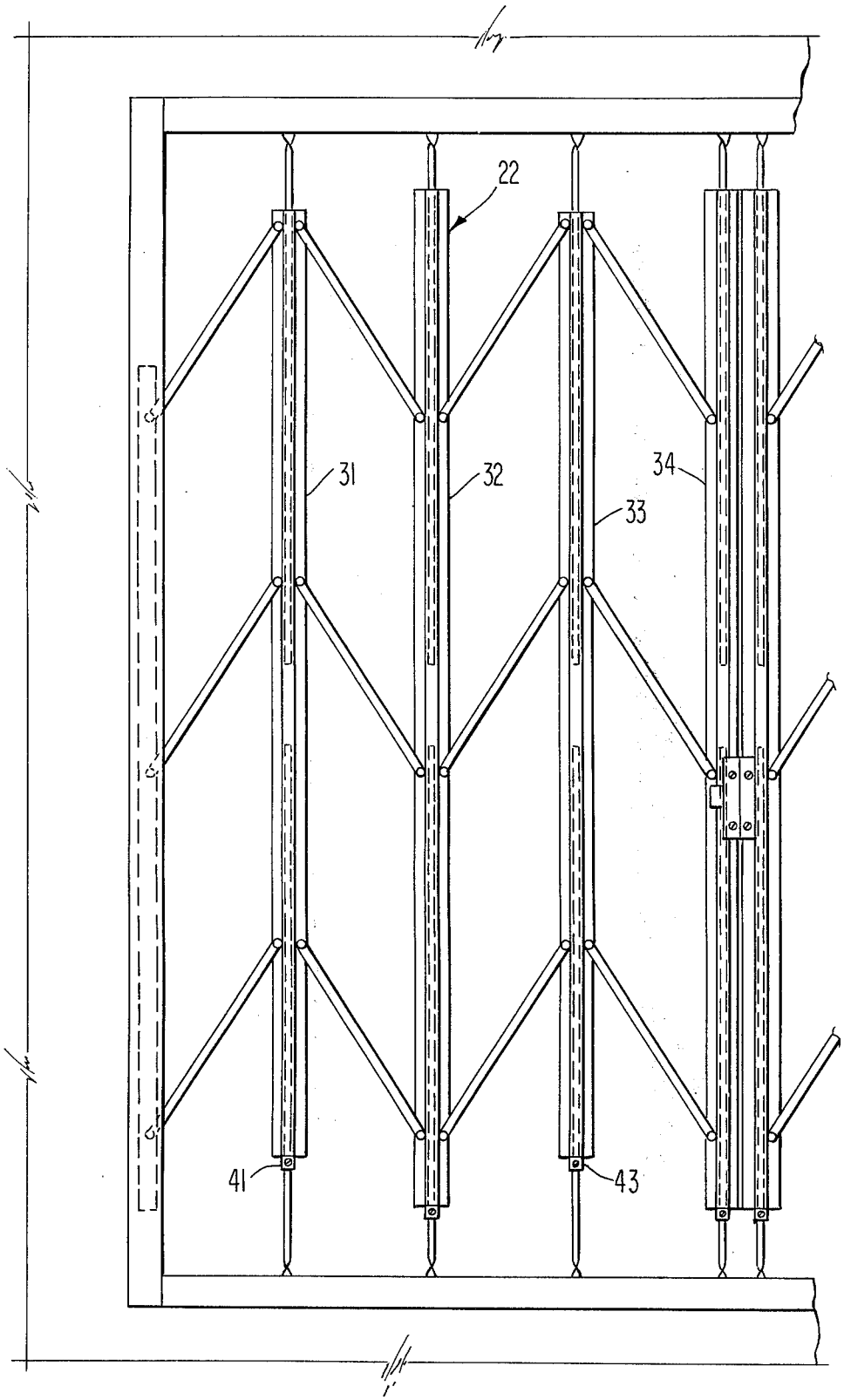

FIG. 5 is an alternative view of a screen such as that of FIG. 2, but being slightly horizontally compressed, such that its several vertical bars or members are closer to each other with the screen in its expanded or closed condition, for accommodating a window of narrower dimension width-wise than the window for the screen of FIG. 2, although adapted for a window of the same vertical height as the window for which the screen of FIG. 2 is adapted.

Figure 6:
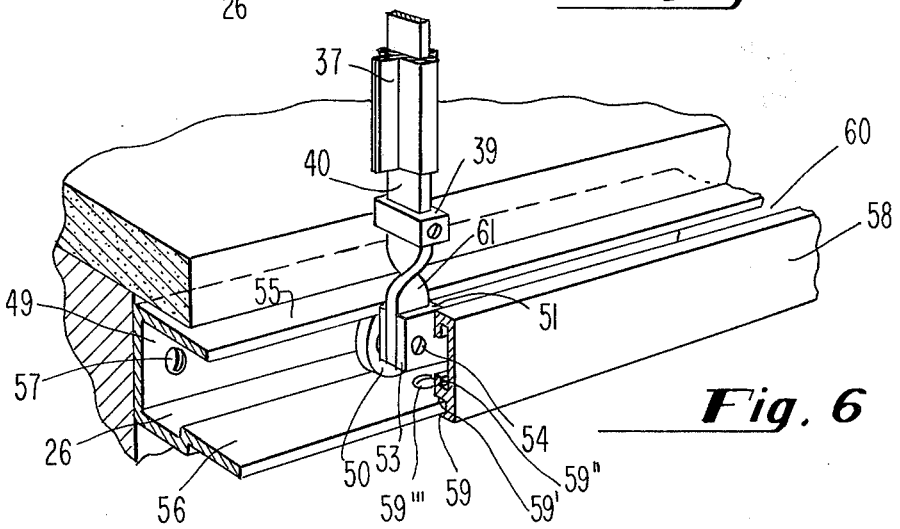

FIG. 6 is an enlarged fragmentary perspective view, partially broken away, of one of the roller and guide member details for the vertical bars of the screen of the present invention.

Figure 7:
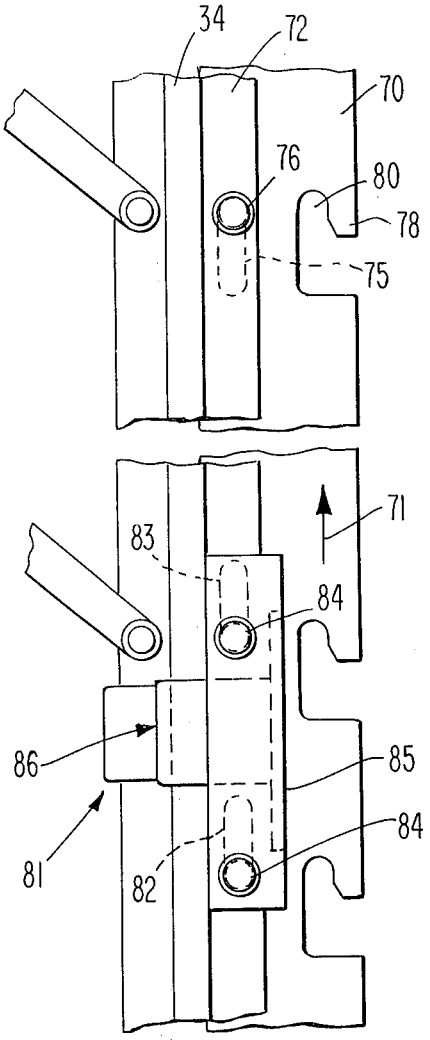

FIG. 7 is an enlarged fragmentary detailed view of the mating bar of the screen of FIG. 2, wherein the latching member is specifically illustrated.

Figure 1:
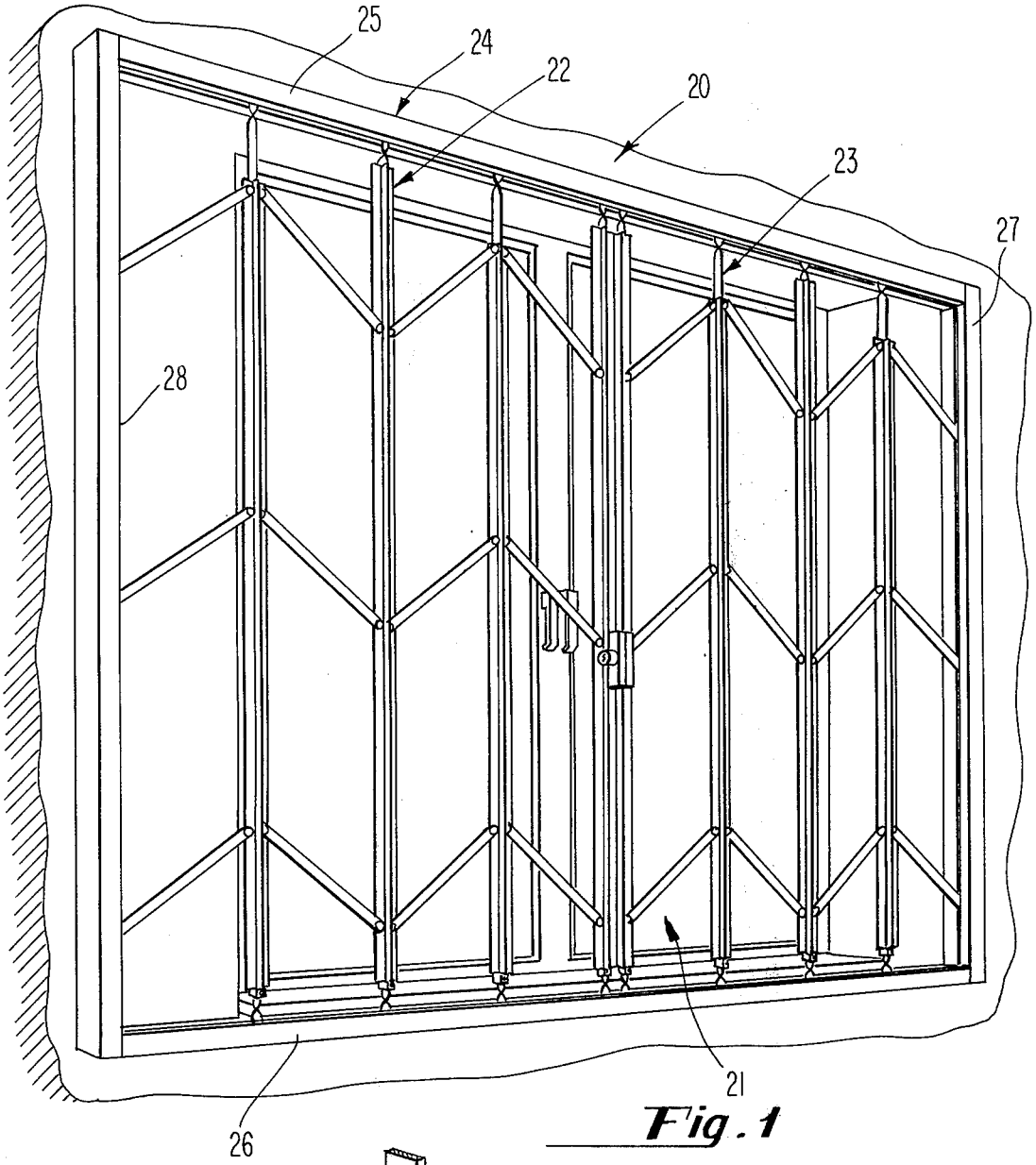
FIG. 1 is an inside frontal perspective view of a pair of screens in accordance with the present invention, installed over an opening of the window type, with the screens being closed, to provide security with respect to the opening.
Figure 8:
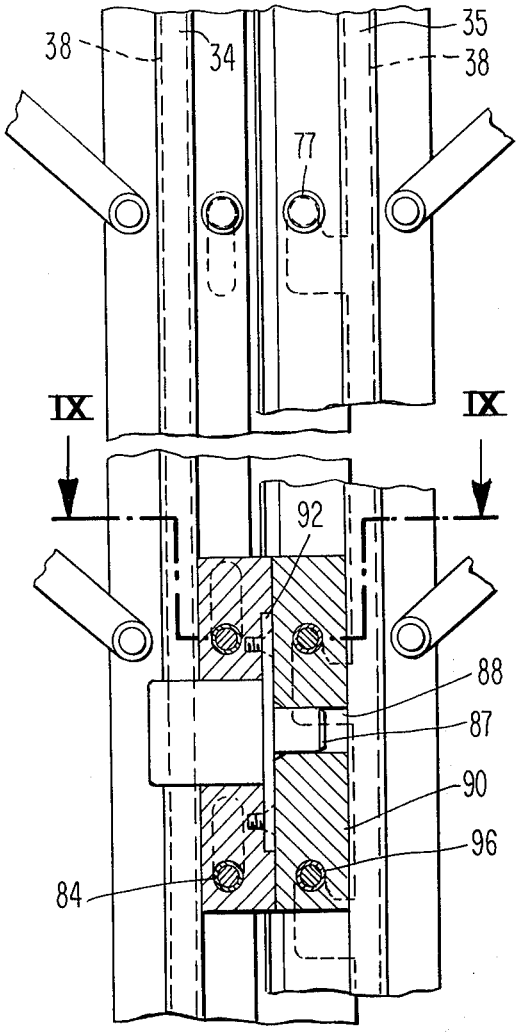

FIG. 8 is an enlarged fragmentary view of the pair of mating bars associated with the pair of screens illustrated in FIG. 1, wherein further details of the latching mechanism are specifically illustrated.

Figure 9:
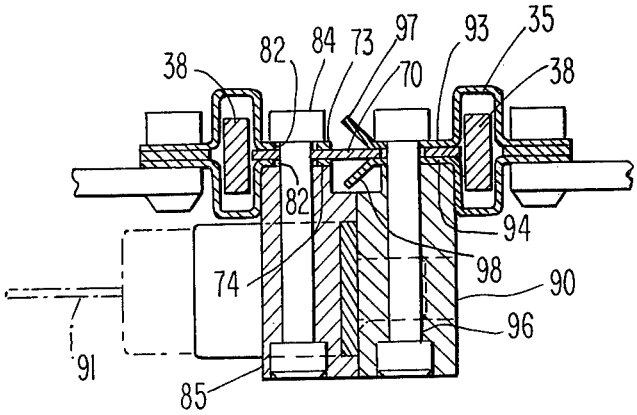

FIG. 9 is a transverse sectional view taken through the latching details illustrated in FIG. 8, generally along the line IX — IX of FIG. 8.

Figure 10:
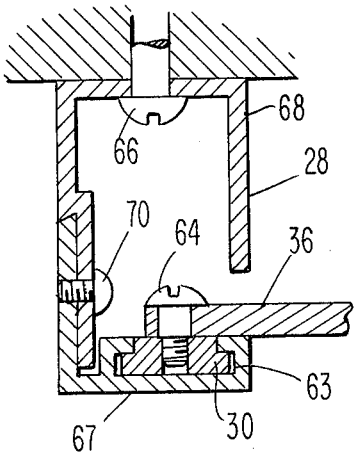

FIG. 10 is an enlarged sectional view of an end bar mounting detail, taken generally along the line X — X of FIG. 2.

Figure 11:
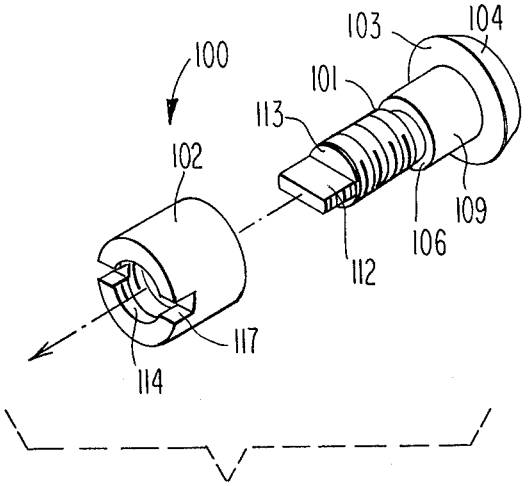

FIG. 11 is an enlarged perspective view of the components of a security fastener in accordance with the present invention.

Figure 12:
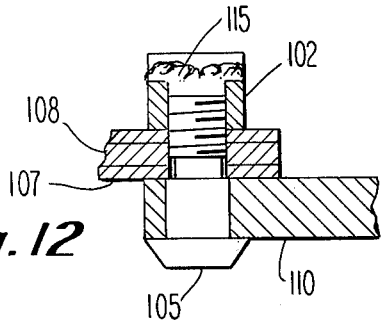

FIG. 12 is a transverse cross-sectional view of the fastener of FIG. 11, in use, connecting a pivot link to a flange of a longitudinally disposed bar of the screen of the present invention.

Figure 13:
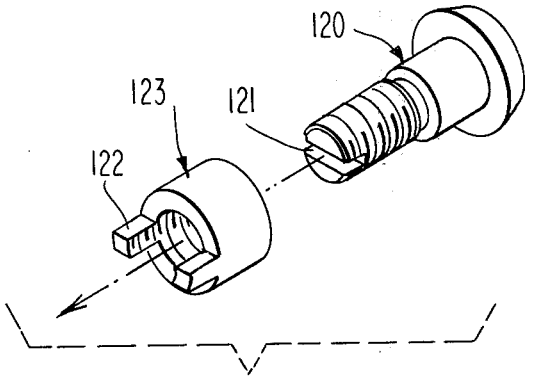

FIG. 13 is a view like that of FIG. 11, but wherein an alternative embodiment of a security fastener is illustrated.

Figure 14:
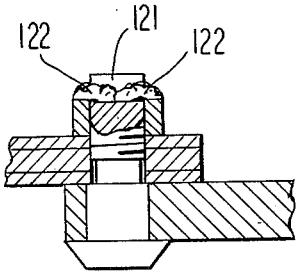

FIG. 14 is a view like that of FIG. 12, but wherein the fastener embodiment of FIG. 13 is illustrated.

Figure 15:
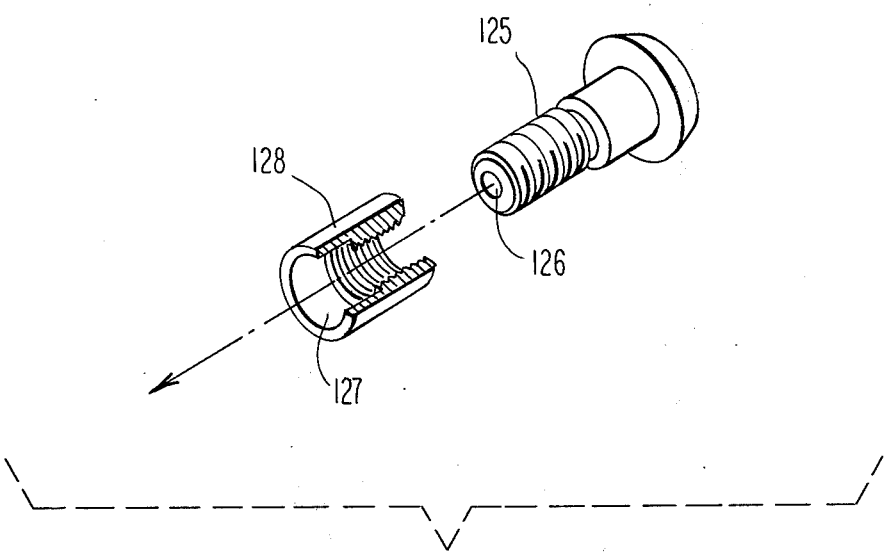

FIG. 15 is an enlarged perspective view of the components of another alternative embodiment of a security fastener, with portions of the female element broken away and illustrated in section, for purposes of clarity.

Figure 16:
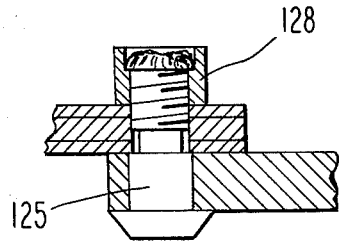

FIG. 16 is a transverse sectional view, like that of FIG. 12, but of the fastener embodiment illustrated in FIG. 15.

DESCRIPTION OF THE PREFERRED EMBODIMENTS

Referring now to the drawings in detail, reference is first made to FIG. 1, wherein a security screen system 20, in accordance with this invention is generally illustrated, applied over a double window 21 of the casement window type, with the screen assembly 20 being illustrated as mounted on the inside of the wall over the window 21.

The window system 20 employs a left screen 22 and a right screen 23, mounted as illustrated in a frame 24. The frame 24 includes an upper vertical frame member 25, a lower vertical frame member 26, and right and left vertical members 27 and 28, respectively.

The screens 22 and 23 are substantially identical, although they are opposite-hand complements of each other, so that only the screen 22 will be specifically described in detail.

The screen 22 employs an outer or left end-most anchoring bar 30, slideably disposed for vertical sliding movement in frame member 28 (see FIG. 2).

Adjacent the bar 30 is a vertically telescopically slideable bar 31, identical with a similar bar 33. Intermediate the bars 31 and 33 is a link-anchoring vertically disposed bar 32. Each of the bars 31–33, it will be seen, is comprised of a sleeve-like main bar portion (31*a*, 32*a*, 33*a*, respectively) with rods 38, 40, 41 or 42 extending telescopically from opposite ends thereof. The right-most vertically disposed main bar portion 34*a* of bar is a mating bar, and is also of the link-anchoring type as opposed to the telescopic type, the bar portion 34*a* being adapted to mate with a complemental vertically disposed main bar portion 35a of link-anchoring bar 35 of the screen 23.

A plurality of angularly oriented links 36 are employed, each pivotally connected to flanges 37 of the bars 31, 32, 33, 34, or to the slide bar 30, for pivotal movement relative to those bars. Thus, the links 36 are pivotally connected at each of their ends for facilitating a folding of the screen between open and closed positions thereof.

Figure 4:
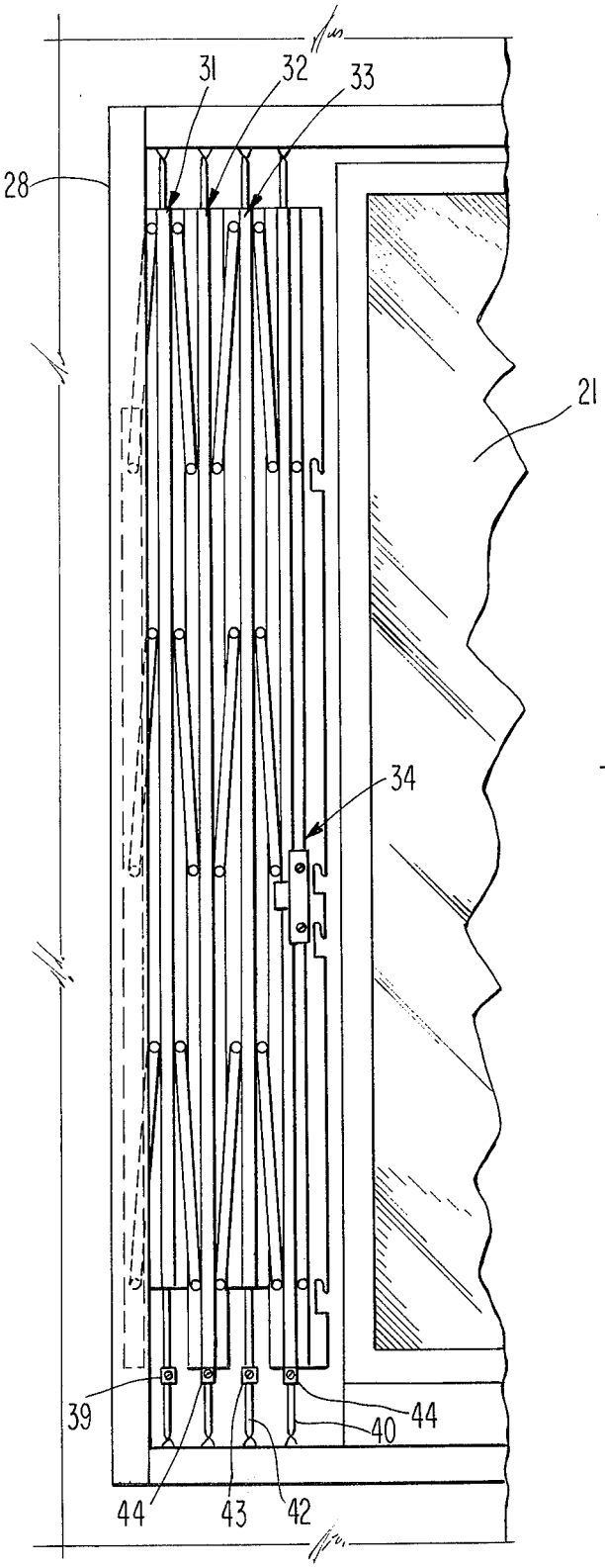
FIG. 4 is a view of the screen of FIG. 2 in its opened or laterally compressed condition, as for example, when security is not desired, and wherein the compaction of the screen for storage purposes is specifically illustrated.

Each of the telescopically slideable bars 31 is provided with a pair of rods 38 and 40 disposed, respectively, at upper and lower ends of the screen 22. The rods 38 and 40 are of metal, for example, aluminum construction or the like, and are adapted for a sliding fit within the interior of the aluminum stock telescopic main portions of the bars 31, for upward sliding movement of the main bar portion 31*a* or 33*a* over their associated rods 38 and 40, as the screen 22 is collapsed or opened from the position illustrated in FIG. 2, to a closed position as illustrated in FIG. 4.

An adjustable stop 39 is provided on the rod 40 for limiting the downward movement of the main bar portion 31*a* of the bar 31 over the rod 40. This type of stop is particularly helpful if it is desired that the screen 22 have a uniform spacing between the various bars thereof, as illustrated in FIG. 2. This is manifest in that the stop 43 may be set at a given position along the rod 42, and as the bar 34 is moved laterally rightwardly from its position in FIG. 4 for example, toward the closed condition of the screen 22 as illustrated in FIG. 2, the bar portion 33*a* 33 will descend along the elongable means or rods 41 and 42, to the position limited by the stop 43. Upon the bar portion 33*a* reaching this downward position, continued rightward movement of the bar 34 will cause the bar 32 to commence rightward movement. Regardless of the number of bars associated with the screen, this process will continue, such that the telescopic ones of the bars will move toward a closed position of the screen 22 in serial fashion, rather than all together. It will be noted that the rods 41, 42, 40 and 38 are all identical, having been given different numbers for purposes of explanation only.

It will also be apparent that the stops 39, 43 and 44 are all provided with suitable threaded fastening means 45, of preferably the set screw type.

The main bar portions 32*a* and 34*a* of link-anchoring bars 32 and 34 are also adapted for vertical adjustment relative to their rods 38 or 40, but such telescopic adjustment or movement of the bar portions 32*a* or 34*a* relative to their rods does not occur during the opening and closing of the screen 22. However, it will be apparent that the stops 44 associated with the link-anchoring bars 32 and 34, for example provide a means for accommodating the screen 22 to various vertical window sizes. For example, with specific reference to FIG. 3, it will be seen that the bars 32 and 34 are arranged such that the rods 38 and 40 thereof are extended outwardly beyond the ends of the bars 32 and 34, moreso than in FIG. 2, such that in the illustration of FIG. 3, it will be apparent that the same screen as used in FIG. 2, upon simple adjustment, can accommodate a window of larger vertical size. Of course, a comparable adjustment would be necessary in the placement of the stops 39 and 43, to obtain the same desired spacing laterally, or horizontally, between the various bars.

Figure 3:
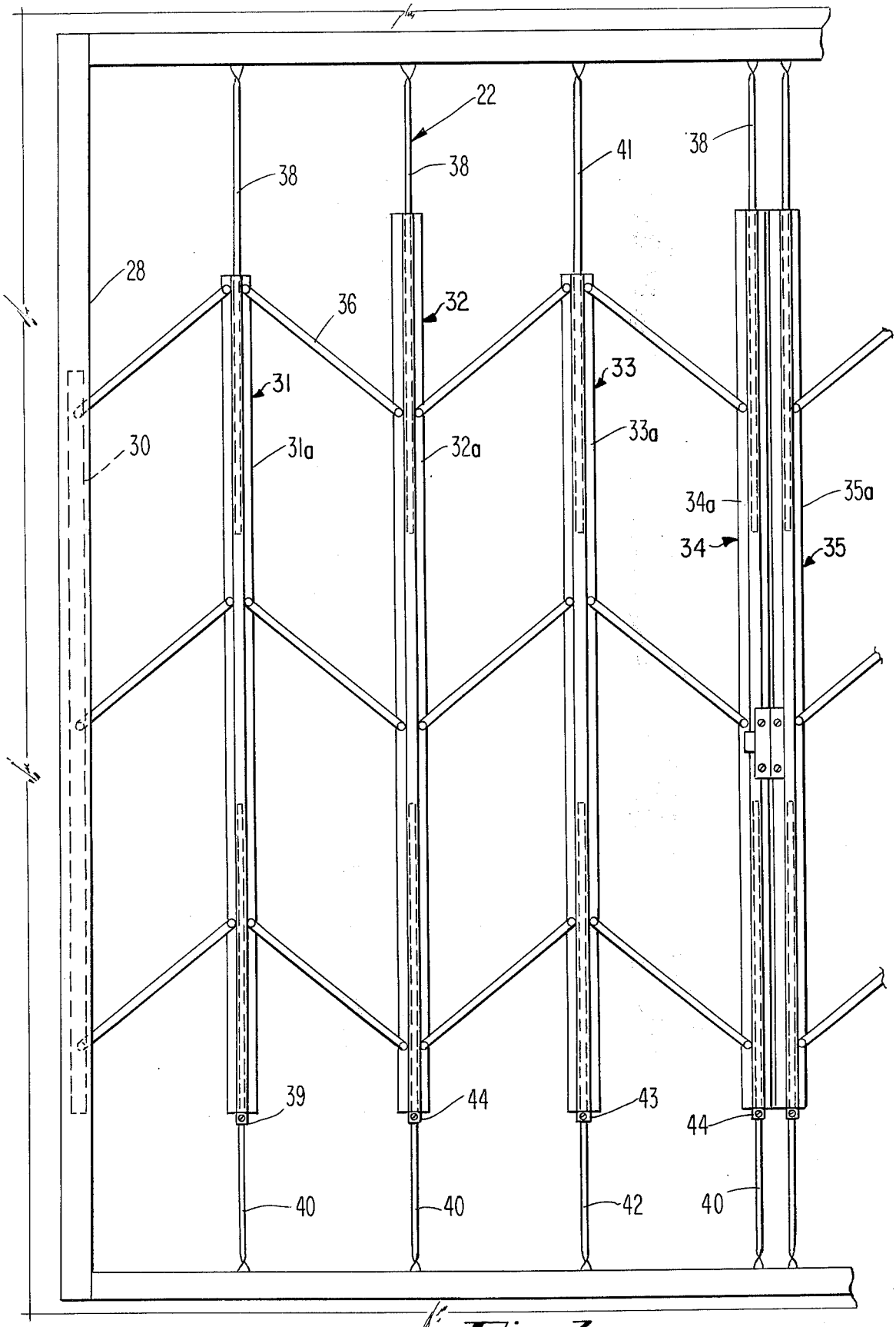
FIG. 3 is an alternative view of the screen of FIG. 2, used in a vertically expanded condition, as it would be used for example to accommodate a window of larger vertical size than the screen as assembled in FIG. 2, in that the vertical bars of the screen of FIG. 3 are expanded endwise.

With specific reference to FIG. 5, an alternative condensed or more compressed arrangement for the expandable screen 22, is illustrated, utilizing the same components illustrated in FIGS. 2 and 3, but wherein the vertical height of the window for which the screen is adapted in FIG. 5 is substantially the same as that for the screen as employed in FIG. 2, but wherein the horizontal size of the window would be smaller. Illustrating the versatility of the screen 22 to accommodate smaller sized windows, it will be seen that the link-anchoring bars 32 and 34 are located closer to their adjacent and intermediate telescopically moveable bars 31 and 33. In order to control the uniformity of spacing between the bars as illustrated in FIG. 5, the stops 39 and 43 associated with the bars 31 and 33 are suitably pre-positioned by adjustment, substantially as illustrated in FIG. 5, upon installation of the screen 22 inside a window or door.

At opposite ends of the bars 31 through 34, guiding means are provided for the rods 38, 40, 41, 42, etc., in the form of rollers of the wheel type 50, as illustrated in FIG. 6, suitably shaft-mounted on a base 51 formed by metal components 52 and 53 secured to the lower end of a rod 40. The shaft 54 may be suitably mounted in any suitable manner, as by bearings or the like, so that the roller 50 will roll freely thereon. In any event the rollers 50 are free to roll in a guide or track provided between upper and lower plates 55 and 56 of the extrusion that forms the upper or lower frames 25 or 26, as illustrated in FIG. 6. Such extrusion 49 being mounted to a wall by suitable fasteners 57. A front member 58 cooperates with the member 55 to provide a track or guideway 60 therebetween, through which the lower ends 61 of the rods are passed in guiding engagement. The member 58 has a lower lip 59 connected to plate 56 by fasteners 69. This permits assembly of the frame in tight areas, such as inside dormers, where the vertical bars cannot be slid into the guideway 60 from an end. By the frame construction of FIG. 6, in tight areas first the frame member 49 can be fastened to the wall, then the bars installed with their rollers 50. Then member 58 can be applied with the lip of plate 56 received in slot 59′ between lips 59″ and 59, fastened by fasteners 59‴. Alternatively, the entire structure 26, and that 25 may be manufactured as a single extrusion, rather than in separate parts, and will have a function substantially as that described and illustrated for the embodiment of FIG. 6, except for the ease of assembly in tight places. The guiding for each of the rods, whether associated with a telescopically moveable bar, or a link-anchoring bar, is substantially the same, and such description will not be duplicated herein.

With particular reference to FIG. 10, it will be noted that the end bar 30 is provided in a frame construction 28, having a cross-section as illustrated in FIG. 10, such that the bar 30 is free to slide in a guideway 63, and with links 36 being connected at a plurality of vertically spaced locations along the bar 30 as illustrated in dotted lines in FIG. 2, and as illustrated in FIG. 10, by suitable threaded fasteners 64. The threaded fasteners 64 may be in the form of shoulder bolts or the like, as desired, as may be the pivot joints or pins 65 illustrated in FIG. 4, if desired. However, it may be desired to use special rivets, screws or fasteners for the pivot pins 65, that may not be readily disassembled by a screwdriver or the like, and as are discussed more thoroughly hereinafter.

In any event, the bar 30 may slide vertically in the guideway 63 therefor. It will be noted that the frame 28 illustrated in FIG. 10 is of two piece construction, so that the bar 30 may be separately assembled, after one portion of the frame 28 is secured to a wall by suitable fasteners 66, and then the other portion 67 of the frame 28 may be fastened to the one frame portion 68 by suitable fasteners 70, again for ease of assembly in tight places.

With particular reference to FIGS. 7 through 9, the latching and locking means of the present invention will be more specifically described.

The bars 34 and 35 are each provided with suitable rods 38 therein, as illustrated in FIG. 9, that function relative to the bars 34 and 35, in the same general manner as do the rods associated with any other link-anchoring bar.

With specific reference to FIG. 7, the bar 34 is seen to have a securement means of the latch type, including a latching plate 70 of substantial length (generally of the same or approximately the same length of the bar 34), extending rightwardly therefrom, as illustrated. The latching member 70 is adapted for vertical upward movement as indicated by the arrow 71, relative to the flange 72 of the bar 34, in that, the left-most end of the latching member 70 is disposed between spaced-apart flanges 73 and 74 of the bar 34. The latching member or plate 70 is provided with slotted holes 75, in order to accommodate upward sliding movements of the plate 70 between the flanges 73 and 74, but with the plate 70 being guided in its vertical movement by passage of the slotted holes 75 over the fixed bolts 76, that are fixedly carried by the flanges 73 and 74, extending through round holes thereof, and through an intermediate slotted hole 75. Thus, the lower end of the slotted hole 75 as illustrated in FIG. 7 will become more closely adjacent the bolt 76, as the plate member 70 is moved vertically upward to pass over other bolts or engagement portions 77, over which hooks corresponding engagement portions or 78 of the latching plate 70 are to engage, such that the bolts 77 are in engagement within openings 80.

At the location of the locking mechanism 81, slotted holes 82 and 83 exist in each of the spaced apart flange portions 73 and 74 of the bar 34, to accommodate vertically upward and downward sliding of bolts 84 therein, with the bolts 84 being secured to both a locking block 85 and to the vertically moveable latching plate 70, such that the block 85 and the plate 70 move upward and downward together, relative to the flanges 72 and 73, as latching of the screen is to be effected.

A suitable key-operable locking device 86 is provided, as part of the securements means suitably disposed in a void of the block 85, for movement between the phantom and full line positions illustrated in FIG. 9, for correspondingly driving a bolt 87 therewith, into a suitable keeper hole 88 in a fixed locking block 90 that in turn is fixedly and rigidly carried by the bar 35, against vertical movement. Thus, upon turning a key 91, the locking member 87 passes through its mounting plate 92 that in turn is suitably threadably carried by the block 85, and with the locking member 87 thereby entering into locking engagement within the keeper void 88 of the block 90. The block 90 is fastened to spaced-apart flanges 93 and 94 of the bar 35 by mounting bolts 96 that pass through round mounting holes in the flanges 93 and 94, and with the space between the flanges 93 and 94 accommodating the locking plate 70 as the plate 70 is moved therebetween and dropped downward with its hooks 78 in engagement over bolts 96 between the flanges 93 and 94.

It will be noted that the flanges 93 and 94 are flared outwardly as illustrated in FIG. 9, in order to easily accommodate the plate member 70 to be inserted therebetween.

It will be apparent from the foregoing that the latching and locking mechanisms of the present invention are readily adapted to accomplish their ends, of securely locking the mating bars 34 and 35 at several spaced-apart locations, by the latching being effected at several spaced-apart locations throughout the lengths of the bars, and with the locking being conveniently centrally located at the location 81 illustrated in FIG. 2.

It will further be apparent, that for a given building, installation or the like, the locking mechanisms may all be keyed to the same key, as desired, and the key be located at some convenient place for facilitating egress from the building under emergency conditions.

With reference now to FIGS. 11 through 16 in particular, the security fastener of the present invention will be addressed most particularly. It has heretofore been stated that the fasteners 65 may be of any type. However, the fasteners will preferably be of a permanent locking, non-reversible type, generally designated by the numeral 100. It will be recognized that the screen is particularly adapted for prevention of theft, access when undesired, and the like. To this end, it is desired to use a fastener that may not be readily disconnected by a burglar or the like. Accordingly, the fastener 100 employs a screw member 101 and a nut member 102. The screw member 101 has a head 103 that has a frusto-conical surface 104, as illustrated, and a flat surface 105. It will be noted that no slotted hole, or other void or recess is provided on the head 103, as would lend itself to being unconnected or unturned by a screwdriver or similar tool. The member 101 also is provided with a cylindrical portion 109 that terminates in a shoulder 106, for engagement against a surface 107 of a link 108, in use, with the cylindrical portion 109 passing through a flange portion 110 of a bar, as illustrated in FIG. 12. At this point it will be noted that the screw and nut could be applied reversibly, with the nut in engagement against the undersurface of the flange 110 as illustrated in FIG. 12, although preferably, the nut 102 will be provided on the inside of the screen with which it is used, and as illustrated in FIG. 12.

The opposite end of the screw member 101 is provided with a flat planar portion 112, with screw threads on opposite ends, in that it has preferably been made by cutting away or notching portions 113 therefrom. Upon threaded engagement of the threads of the member 101 with internal threads 114 of the nut 102, as illustrated in FIG. 12, the portion 112 of the screw member 101 may then be hammered, peened, or likewise deformed permanently to have a deformed configuration such as that illustrated at 115 in FIG. 12, whereby portions of the flattened portion 112 will engage within opposite cuts or notches 117 in the nut member 102, to prevent unscrewing of the threaded member 101 and the nut 102 relative to each other.

It will further be noted that the deformation of the type indicated by the numeral 115 is permanent in the sense that it does not involve the mere bending of a lug or extension portion, in hinge-like fashion, such that it could readily be returned to an original position that would facilitate unscrewing of the members relative to each other. To the contrary, it is intended that the deformation be in the form of "upsetting", or metal movement of the type that would be effected by pounding and hammering or peening metal to achieve a locking engagement of the type illustrated in FIG. 12, such that the metal that originally comprised a portion of the flat 112 could not readily be removed from the notches 117 for disconnection of the parts. Furthermore, the outer periphery of the member 102 is circular in configuration, as illustrated, and is not provided with flats thereon, as are conventional nuts, to further render difficult the turning of the nut member 102 relative to the screw member 101, and to thereby further discourage disconnection of the fastener components relative to each other.

With reference to FIG. 13, a screw member 120 is provided, somewhat like that 101 of FIG. 11, but wherein, instead of the flat 112, there is provided a slot 121, extending across the end of the threaded portion of the screw member 120 as illustrated in FIG. 13, such slot being adapted to receive pounded, peened, hammered or otherwise permanently and non-reversably deformed portions of extended lugs 122 located opposite each other at one end of the nut member 123. The nut member 123 is likewise constructed similarly to the member 102, but, as will be seen in FIG. 14, the lug portions 122 are adapted to be received within the corresponding locking portions or slots 121 of the member 120, again by permanent deformation techniques, rather than by simple reversible bending techniques that lend themselves to ease of disassembly of fastener members. It will be noted that, because of the permanent deformation technique utilized, the members 122 may not be readily engaged by a screwdriver or the like and returned to their extended positions illustrated in FIG. 13.

With reference now to FIG. 15 in particular, a third embodiment of the preferred fastener of the present invention is illustrated, as comprising a screw member 125, and a nut member 128. These members are constructed generally similarly to the previously discussed embodiments of FIGS. 11 through 14, except that the screw member 125 is provided with a bore or void 126 in the end thereof that facilitates receipt of a punch, or other tool, after assembly of the screw and nut as illustrated in FIG. 16, in threaded engagement with each other, whereby a punch placed in the bore or void 126 and struck with a hammer or the like will cause the metal in the threaded portion of the screw at that end of the screw, to become pounded over, or enlarged in diameter an amount sufficient to be received within the counter-bore 127 of the nut member 128. Further pounding or peening will yield a deformation such as that illustrated in FIG. 16, again non-reversably deformed for the reasons set forth above.

It will be apparent that the fasteners of the present invention are adapted to accomplish their ends.

It will also be apparent that modifications may be made in the details of construction, as well as of in the use and operation of the device of the present invention. For example, it may be desired to use stops also at upper ends of the link-anchoring bars, such as those 32 and 34, if desired. However, such is not essential. Moreover, the various stops may be placed to govern the centering of the flanged tubular main sections of the bars vertically, if vertical centering is desired, or the stops may be adjusted to permit any placement of the main portions of the bars along their rods; such as lower-than-center, higher-than-center, as desired.

Upper stops would be particularly desirable if the bars 32, 34, etc. were not to be vertically disposed, but used in a non-vertical plane, for example over a horizontal cellar-way or the like, wherein bar weight longitudinally along rods could not readily facilitate positioning of bars relative to their rods. When the screen is in the vertical plane, stops are therefore optional. In the claims, the word "longitudinal" is intended to encompass any plane of use of a screen whether vertical, horizontal, or angular, etc. While "vertical" is used to describe the orientation of the bars and rods, etc., such is for purposes of example only. Also, in this application, words such as "upper" and "lower" and "lateral" are not to be limiting, but are used only for ease of understanding the particular embodiments illustrated. Accordingly, nothing herein should limit the screen of this invention as regards orientation.

Also, any desired number of links 36 may be used, to control the size of openings, depending upon the desired conditions. As aforesaid, the links may be pivotally mounted permanently, or removed as desired. In many installations, rivets or the like that are not removable by a screwdriver may be preferred. Also, one-way screws may be utilized, if desired.

It will further be apparent that in some instances it may be desired to use only a single screen, opening from one side of a window to the other, as for example, in very narrow windows or doorways. In other circumstances it will be desired to use a pair of screens specifically as illustrated in FIG. 1 of the drawings. In still other instances it may be desired to cover a very wide opening, in which case several screens may be used together.

It will be noted that, with respect to the illustration of FIG. 6, not only is access to the fastening means 59''' available through the spacing or opening 60, for fastening the two lip portions 56 and 59 thereof together, but also, with respect to the embodiment of FIG. 10, access is provided through the opening that accommodates the passage of the links 36, to fasteners 70, also for fastening together those lip portions of the two members that comprise the frame 28.

A further modification of this invention resides in the provision of a kit that is not assembled as two compressed screens, ready for assembly onto a frame, but wherein the kit is provided in the form of a plurality of bars, and with separate rods provided for insertion into main portions of the bars, also with stops being provided, links being provided, fasteners being provided for connecting the links to the bars, frame members provided for above and below the screen, and for acting as guideways for rollers carried by ends of the rods, with the frame members being in knocked-down, or completely disassembled form, for assembly in situ. Thus, the kit may comprise completely disassembled elements, adapted for combination in the manner that will be apparent from the entire disclosure of this application, and upon assembly of the various parts necessary in order to make a screen cover for a desired opening, will embody the various components illustrated in drawings 1 through 16, and described herein in greater detail.

It will further be apparent from the foregoing that various other modifications may be made in the present invention, and in its use, all within the spirit and scope of the invention as defined in the appended claims.

Having thus described my invention, I claim:

1. A foldable security screen apparatus of the optionally openable and closeable type for use in covering an opening of the window, door or other types comprising:

a. a plurality of longitudinally disposed laterally repositionable bars, b. a plurality of links extending between and connecting adjacent said bars, each link having one end pivotally anchored on a said bar and each pivotally connected at its opposite end to a next adjacent said bar, c. guide means disposed at opposite ends of said bars forming guide paths for guiding the lateral movement of said bars upon lateral repositioning thereof, wherein said guide means comprise laterally movable means at the ends of said bars and fixedly disposed track means for guiding movement of said laterally movable means relative thereto, d. said bars each being connected to said guide means at both opposite ends of each said bar, e. said bars being telescopically extensible and contractible and comprising means that include main bar portions between bar ends, for expansion and contraction in effective bar length between said guide means whereby the bars can automatically accommodate to variations in said guide paths by permitting corresponding automatic variations in effective bar length between ends thereof, whereby the bars can, upon installation optionally accommodate an infinite variety of opening lengths within a preselected range, and whereby the bars facilitate screen opening by lengthwise movement of some of the main bar portions relative to associated said bar ends, and f. said bars including means for selectively limiting relative telescopic movement between at least some of said main bar portions and associated bar ends, whereby upon installation the spacing between selected ones of said bars may be optionally adjusted for accommodating an infinite variety of lateral opening sizes within a preselected range, and whereby desired selected spacings between adjacent bars may be established.

2. The apparatus of claim 1, wherein said screen is provided with securement means for securing the screen in closed condition.

3. The apparatus of claim 1, with the ends of said bars including rod means extending longitudinally from said main bar portions, and with the ends of the bars being in guided engagement with said guide means, and wherein the said main bar portions of each of said bars is of the generally hollow type, and with the rod means comprising separate rods disposed partially in and extending from opposite ends thereof and being adjustably slideably repositionable therein.

4. The apparatus of claim 3, wherein said means for selectively limiting comprise stop means adjustably disposed on said rod means for engagement by telescopically slideable main bar portions for limiting the longitudinal movement of the said bar portions along the rod means.

5. The apparatus of claim 1, wherein said screens are provided in pairs openable away from each other and closeable toward each other, with each of the screens having one end-most bar thereof adapted for a substantially abutting engagement with an end-most bar of the other screen of the pair, said end-most bars being provided with complementary components of a latching mechanism comprising means for latching the two screens together at abutting said bars.

6. The apparatus of claim 1, wherein one of said complementary components comprises a longitudinally slideable plate member, slideably carried by a said end bar, and having hook portions thereon engageable with keeper portions on the other said end bar, and with said other end bar having keeper portions fixedly carried against longitudinal movement relative to the bar on which said keeper portions are carried and adapted for engagement by said hook portions.

7. A security cover kit for covering openings, said kit being of the type having at least one foldable screen adapted to be anchored at one end and foldable away from that end over an opening, the screen comprising a plurality of generally longitudinal parallel bars with adjacent bars connected to each other by a plurality of pivotally attached links, each link having one end pivotally anchored on a said bar and each pivotally connected at its opposite end to a next adjacent said bar, and with guide means being provided for attachment at locations above and below the opening and adapted to guidingly engage upper and lower ends of the bars for guiding the lateral movement of the bars upon lateral repositioning thereof, said bars being telescopically extensible and contractible and comprising means that include main bar portions between bar ends for expansion and contraction in effective bar length between said guide means whereby the bars can automatically accommodate to variations in said guide paths by permitting corresponding automatic variations in effective bar length between ends thereof, whereby the bars can, upon installation optionally accommodate an infinite variety of opening lengths within a preselected range, and whereby the bars facilitate screen opening by lengthwise movement of some of the main bar portions relative to associated said bar ends, and said bars including means for selectively limiting relative telescopic movement between at least some of said main bar portions and associated bar ends, whereby upon installation the spacing between selected ones of said bars may be optionally adjusted for accommodating an infinite variety of lateral opening sizes within a preselected range, and whereby desired selected spacings between adjacent bars may be established.

8. The kit of claim 7, with said means for selectively limiting relative telescopic movement including adjustably positionable stop means carried by at least some of said bars for facilitating selective longitudinal positioning of the bars relative to an opening.

9. The kit of claim 8, wherein the stop means comprise:

a. adjustable stop means that are placed on alternate ones of the adjacent rods for limiting, in use, longitudinal position of associated main bar portions relative to their associated rods, b. adjustable stop means placed on those rods that are laterally intermediate the alternate ones, for limiting in use, the maximum lateral separation of adjacent bars.

10. The kit of claim 8, wherein the bars comprise separate rods adapted for independent telescopic movement in said main bar portions.

11. The kit of claim 10, wherein the screen is provided with latching means for opening and closing movement therewith when assembled and with at least one complemental interengaging latching component being provided for fixed mounting relative to the opening, with locking means being provided for locking the latching means and latching component in interengaged relation.

12. The kit of claim 10, wherein the upper and lower ends of the bars are provided with rollers for guidingly connecting the ends of the bars in said guide means.

13. The kit of claim 7, wherein at least one of said guide means includes a frame member, said frame member having two parts, with one said part having a surface portion for mounting on a surface in which the opening to be covered is disposed and having a lip portion extending substantially perpendicular to said surface portion, and first fastening means being provided for fastening said one part to a surface having the opening to be covered therein, and with the other said part having a lip portion adapted to mate with the lip portion of said first part and having a screen-mounting portion disposed generally perpendicular to its said lip portion, with second fastening means being provided for fastening together the lip portions of said two parts, and with a spacing being defined between the two parts of said frame member, and with means provided on said lip portions of said parts and located in sufficiently substantial alignment with said spacing to provide access to said second fastening means through said spacing to apply said second fastening means to said lip portions.

14. A foldable security screen of the optionally openable and closeable type for use in covering an opening of the window, door or other types comprising:

a. a plurality of longitudinally disposed laterally repositionable telescopically slideable bars alternately intermediate longitudinal link-anchoring laterally repositionable bars, b. a plurality of links, each pivotally anchored on said link-anchoring bar and each pivotally connected to an adjacent telescopically slideable bar, c. guide means for guiding the lateral movement of said bars upon lateral repositioning thereof, d. said telescopically slideable bars each being provided with rod means extending longitudinally from ends thereof, e. said rod means being in guided engagement with said guide means, f. said bars, rod means and links being operatively related so as to comprise means whereby lateral movement of a longitudinal link-anchoring bar relative to a next adjacent longitudinal link-anchoring bar, effects a longitudinal displacement of an intermediate said telescopically slideable bar relative to its said rod means together with a correspondingly associated angular change in the positions of said links connected thereto, wherein each of said bars is of the generally hollow type, and with the rod means of said telescopically slideable bars comprising separate rods disposed partially in and extending from first and second ends thereof, and with separate rods disposed partially in and extending from first and second ends of said link-anchoring bars, with said rods of said link-anchoring bars also being in guided engagement with said guide means, and with those rods that are disposed in the said bars being adjustably slideably repositionable therein, wherein the rods that are disposed extending from second ends of said telescopically slideable bars are provided with adjustably positionable stops thereon for limiting the longitudinal movement of the telescopically slideable bars therealong and for consequently limiting the amount of lateral movement of telescopically slideable bars relative to link-anchoring bars and to thereby provide means for optional adjustment of the screen to accommodate openings of different width sizes, wherein those rods that are disposed extending from second ends of said link-anchoring bars are provided with adjustably positionable stops thereon for fixing the positions of said link-anchoring bars relative to their rods and thereby providing means facilitating optional adjustment of the screen to accommodate openings of different height sizes, wherein said screens are provided in pairs openable away from each other and closeable toward each other, with each of the screens having one end-most bar thereof adapted for a substantially abutting engagement with an end-most bar of the other screen of the pair, said end-most bars being provided with complementary components of a latching mechanism comprising means for latching the two screens together at abutting said bars, wherein one of said complementary components comprises a longitudinally slideable plate member, slideably carried by a said end bar, and having hook portions thereon engageable with keeper portions on the other said end bar, and with said other end bar having keeper portions fixedly carried against longitudinal movement relative to the bar on which said keeper portions are carried and adapted for engagement by said hook portions.

15. The apparatus of claim 14, including moveable locking means carried by said plate member for movement therewith and with fixed cooperating locking means carried by said other end bar and with selectively operable key-operated means being provided for fastening said moveable and fixed locking means together against relative longitudinal movement.

16. A foldable security screen of the optionally openable and closeable type for use in covering an opening of the window, door or other types comprising:

a. a plurality of longitudinally disposed laterally repositionable telescopically slideable bars alternately intermediate longitudinal link-anchoring laterally repositionable bars, b. a plurality of links, each pivotally anchored on said link-anchoring bar and each pivotally connected to an adjacent telescopically slideable bar, c. guide means for guiding the lateral movement of said bars upon lateral repositioning thereof, d. said telescopically slideable bars each being provided with rod means extending longitudinally from ends thereof, e. said rod means being in guided engagement with said guide means, f. said bars, rod means and links being operatively related so as to comprise means whereby lateral movement of a longitudinal link-anchoring bar relative to a next adjacent longitudinal link-anchoring bar, effects a longitudinal displacement of an intermediate said telescopically slideable bar relative to its said rod means together with a correspondingly associated angular change in the positions of said links connected thereto, wherein said links are pivotally anchored on said bars, each with a two-piece fastener, said fastener comprising:

g. a screw member having:

i. a head that is free of any tool-insertable voids, ii. a threaded portion extending from the head and adapted for engagement with threads of a nut member, iii. locking means carried at the end of the threaded portion opposite the head for interengaged locking of the members together in a threaded engagement of the permanently non-reversible metal deformation type;

h. a nut member having:

i. a circular outer periphery comprising means resisting tool interengagement, ii. an internally threaded periphery adapted for threaded engagement with said screw member, and iii. an end having locking means thereon adapted for cooperation with locking means of the screw member for interengaged locking of the members together in a threaded engagement of the permanently non-reversible metal deformation type, and i. said screw member and said nut member being in threaded engagement and with one of said fastener locking means being in permanently deformed interengagement with the other said locking means.

17. A security cover kit for covering openings of the type having a pair of foldable screens each adapted to be anchored at outer ends and foldable toward each other over an opening for mutual latching engagement between the outer ends, the screens each comprising a plurality of generally longitudinal parallel bars with adjacent bars connected to each other by a plurality of pivotally attached links, with the outer end of each screen having an anchor bar, and with the inner end of each screen having latching means adapted for cooperative engagement with the latching means of the inner end of the other screen of the pair, and with guide means being provided for attachment at locations above and below the opening and adapted to guidingly engage upper and lower ends of the bars, the bars having:

a. adjustably positionable means for adjusting the spacing between adjacent bars in the closed or extended position of a screen relative to its opening for accommodating openings of different widths, b. elongable means associated with each of the bars for adjusting the effective length of the bars for accommodating openings of different longitudinal sizes between attached said guide means, and with means at ends of said elongable means for guidingly connecting the elongable means with said guide means, wherein said links are pivotally anchored on said bars, each with a two-piece fastener, said fastener comprising:

c. a screw member having:

i. a head that is free of any tool-insertable voids, ii. a threaded portion extending from the head and adapted for engagement with threads of a nut member, iii. locking means carried at the end of the threaded portion opposite the head for interengaged locking of the members together in a threaded engagement of the permanently non-reversible metal deformation type;

d. a nut member having:

i. a circular outer periphery comprising means resisting tool interengagement, ii. an internally threaded periphery adapted for threaded engagement with said screw member, and iii. an end having locking means thereon adapted for cooperation with the locking means of the screw member for interengaged locking of the members together in a threaded engagement of the permanently non-reversible metal deformation type, and e. said screw member and said nut member being in threaded engagement and with one of said fastener locking means being in permanently deformed interengagement with the outer said locking means.

18. A kit for construction of an openable and closeable security screen, for accommodating different sized openings upon making position adjustments in stops and that upon assembly includes a frame having generally longitudinal bars, with adjacent bars being connected by links, said kit comprising:

a. a pair of first and second frame members, each with bar guide means, b. a pair of end frame members, c. a plurality of hollow bars, each adapted for longitudinal disposition, d. a pair of rods for each bar, adapted for telescopically slideable movement in ends thereof, e. an adjustably positionable stop for a rod of each bar, f. a plurality of links for connecting bars in adjacent parallel relation, g. fasteners for connecting ends of links to bars, and h. means for connecting some links to end frame members, wherein each said fastener is of the two-piece type comprising:

i. a screw member having:

i. a head that is free of any tool-insertable voids, ii. a threaded portion extending from the head and adapted for engagement with threads of a nut member, iii. locking means carried at the end of the threaded portion opposite the head for interengaged locking of the members together in a threaded engagement of the permanently non-reversible metal deformation type;

j. a nut member having:

i. a circular outer periphery comprising means resisting tool interengagement, ii. an internally threaded periphery adapted for threaded engagement with said screw member, and iii. an end having locking means thereon adapted for cooperation with the locking means of the screw member for interengaged locking of the members together in a threaded engagement of the permanently non-reversible metal deformation type.

* * * * *

UNITED STATES PATENT OFFICE

CERTIFICATE OF CORRECTION

Patent No. 4,006,768 Dated February 8, 1977

Inventor(s) William J. Horgan, Jr.

It is certified that error appears in the above-identified patent and that said Letters Patent are hereby corrected as shown below:

Column 4, Line 67, after "bar portion 33a" insert --of bar--;

Column 7, Line 3, delete "hooks";

Column 7, Line 4, after "engagement portions or" insert --hooks--;

Column 9, Line 56, "removed" should be --removably--;

Column 12, Line 17, "9. The kit of claim 8" should be --9. The kit of claim 10--.

Signed and Sealed this

Fourteenth Day of June 1977

[SEAL]

*Attest:*

RUTH C. MASON
*Attesting Officer*

C. MARSHALL DANN
*Commissioner of Patents and Trademarks*